United States Patent [19]

Engelhardt et al.

[11] Patent Number: 5,037,081

[45] Date of Patent: Aug. 6, 1991

[54] PRINTING STATION WITH DELIVERY DEVICE FOR INDIVIDUAL PRINTED SHEETS

[75] Inventors: Günther Engelhardt, Niederstotzingen; Gerhard Lohrmann, Elchingen/Thalfingen; Helmut Riesenegger, Elchingen, all of Fed. Rep. of Germany

[73] Assignee: Mannesmann Aktiengesellschaft, Düsseldorf, Fed. Rep. of Germany

[21] Appl. No.: 457,281

[22] Filed: Dec. 27, 1989

[30] Foreign Application Priority Data

Dec. 27, 1988 [DE] Fed. Rep. of Germany ..... 3844324

[51] Int. Cl.[5] ..... B65H 31/00

[52] U.S. Cl. ..... 271/207; 271/213; 414/791.2

[58] Field of Search ..... 271/207, 213; 414/791.2

[56] References Cited

U.S. PATENT DOCUMENTS

| | | | |
|---|---|---|---|
| 3,052,466 | 9/1962 | Prince et al. | 271/207 X |
| 3,860,127 | 1/1975 | Fassman | 414/791.2 |
| 4,478,403 | 10/1984 | Byrt | 414/791.2 X |
| 4,865,308 | 9/1989 | Krasik | 414/791.2 X |

FOREIGN PATENT DOCUMENTS

| | | | |
|---|---|---|---|
| 0129650 | 10/1979 | Japan | 414/791.2 |
| 00027851 | 2/1986 | Japan | 271/213 |
| 0086359 | 5/1986 | Japan | 271/207 |
| 0291372 | 12/1986 | Japan | 271/207 |
| 0295970 | 12/1986 | Japan | 271/213 |
| 0147767 | 6/1988 | Japan | 271/213 |

OTHER PUBLICATIONS

IBM Technical Disclosure Bulletin, "Sheet Stacking Technique", vol. 17, No. 8, Jan. 1975, Manning & Vetrone.

*Primary Examiner*—Robert P. Olszewski
*Assistant Examiner*—James R. Bidwell
*Attorney, Agent, or Firm*—Cohen, Pontani & Lieberman

[57] ABSTRACT

A printed sheet delivery device (3) for a printing station (1) includes a collection tray (7) reciprocatable by a transverse-displacement drive (6) for receiving and sorting sheets (2) in stacked, printed-side-down relation in transversely staggered groups (4a). A housing (9) separate from and releasably securable to the printing station (1) is formed of a lower housing part (9a) within which the transverse-displacement drive (6) is mounted and an upper housing part (9b) that is contoured to define the collection tray (7). Slide guides (14a, 14b) carried on the bottom (13) of the upper housing part (9b) on both sides transverse to the direction (5) of sheet delivery cooperate with guide ledges (25, 26) on the lower housing part (9a) for guided transverse reciprocation of the upper housing part relative to the lower housing part.

7 Claims, 3 Drawing Sheets

PRINTING STATION WITH DELIVERY DEVICE FOR INDIVIDUAL PRINTED SHEETS

FIELD OF THE INVENTION

The present invention relates to printing stations having or used in conjunction with a delivery device for individual printed sheets. It is more particularly directed to such a delivery device which incorporates a sheet collection tray that is displaceable transverse to the sheet delivery direction by operation of a transverse-displacement drive for sorting sequentially-arranged groups of individual sheets, printed side down, at an inter-group spacing which corresponds to the transverse-displacement path length.

BACKGROUND OF THE INVENTION

A common disadvantage in the use of currently-available printing stations—such for example as laser page printers and the like—is the manner in which such printers deposit sequentially-printed sheets into a delivery bin or tray. The manner in which printed sheets are so deposited typically requires that the stack of printed sheets be subsequently resorted or rearranged by the user in order to place the sheets in their correct sequence, from the first page to the last, from the top of the stack.

A current state-of-the-art delivery device is disclosed in European Patent Al-0 200 481. In that apparatus a page-flipping or turning device is provided between the printing station—from which individual sheets are output printed side up—and the delivery device to attain a stack in which the sheets are properly ordered by their progressively numbered pages from top to bottom in the stack. This functionality is implemented by an expensive, relatively complex device for effecting the flipping or turning of the individual sheets at the inlet of the delivery device. More particularly, the turning device consists of a rotor having pairs of individually-flexible strips between which each face-up printed sheet is received, is flipped through rotation of the rotor, and is then released from between the flexible strips with the printed sides of the sheets face downward.

SUMMARY OF THE INVENTION

It is accordingly the desideratum of the present invention to provide a delivery and sorting device for use in conjunction with a printing station from which printed sheets are ejected in printed-face-down orientation, wherein the delivery and sorting device provides a notably simpler and improved arrangement for driving and guiding the ejected sheets through selected transverse displacement and stacking of the sheets.

In accordance with the present invention, the delivery device is constructed as a releasably removable or replaceable housing that is separate from but normally used in conjunction with the printing station. The housing is formed of a lower part substantially within which the transverse-displacement drive is disposed and an upper part which forms the sheet collection tray and which, in conjunction with the lower part, defines a housing interior space or cavity for the transverse-displacement drive. Slide guides are provided, on both sides transverse to the direction of sheet delivery, on the bottom of the upper housing part to enable relative transverse movement between the upper and lower housing parts.

The releasable mountability or replaceability of the housing facilitates varied usage of the delivery device in conjunction with a printing station and the selection of the housing shape provides an improved arrangement for the transverse-displacement drive. In addition to permitting the bottom of the sheet collection tray to be used for slide guidance, this arrangement renders the structural arrangement by which slide guidance is effected far less noticeable to the user, enables ready and efficient manufacture and assembly of parts, and engenders simplicity in mounting of the delivery and sorting device on a printer, constituting in sum a considerable improvement over prior art apparatus.

Accuracy in the reciprocated transverse movement of the sheet collection tray is, of course, particularly desirable. For improved accuracy in this regard the transverse-displacement drive of the invention may comprise a rack secured to the upper housing part and a transmission-type gear arrangement and associated stepping motor mounted within the lower housing part.

The reciprocated transverse-displacement path may also be accurately defined by providing the lower housing part with upwardly-extended walls at or along the lateral sides of the device and between which the upper housing part is reciprocally movable. This construction also makes possible an efficient connection to side portions of the printing station. This arrangement additionally limits the permissable transverse-displacement path length thus obviating the need for the inclusion of specialized stop structures or elements or the like. It likewise enables the omission of electrical devices such as limit switches and other functionally similar components.

The replaceability or releaseable mountability of the delivery device of the invention to a printing station may be implemented by constructing the upwardly-extending side walls of the lower housing part for displaceable mounting to a pair of side elements disposed, in turn, for pivotal movement on the printing station frame. In this manner, the lower housing part bears the weight of both the protectively-enclosed transverse-displacement drive and the upper housing part. Moreover, inasmuch as the upper and lower housing parts are secured together solely by the slide guides, no special or additional connecting structures are necessary.

The interengagement or securement of the upper and lower housing parts may, more particularly, be implemented by forming the slide guides as L-shaped projections arranged in pairs on the bottom of the upper housing part. Elongated guide ledges of the lower housing part extend in the longitudinal or sheet feed direction and slidably engage the L-shaped projections of the upper part. The guide ledge on one side of the housing part is narrower than that on the other and forms, in the region in which it engages the L-shaped projections, resilient arms to effect such engagement and enable reciprocated sliding movement of the upper housing part relative to the lower housing part over the length of the maximum transverse-displacement path. This slide guide arrangement can be readily assembled and disassembled without the operation or provision of special fastening means and can therefore be economically manufactured and easily mounted for use.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
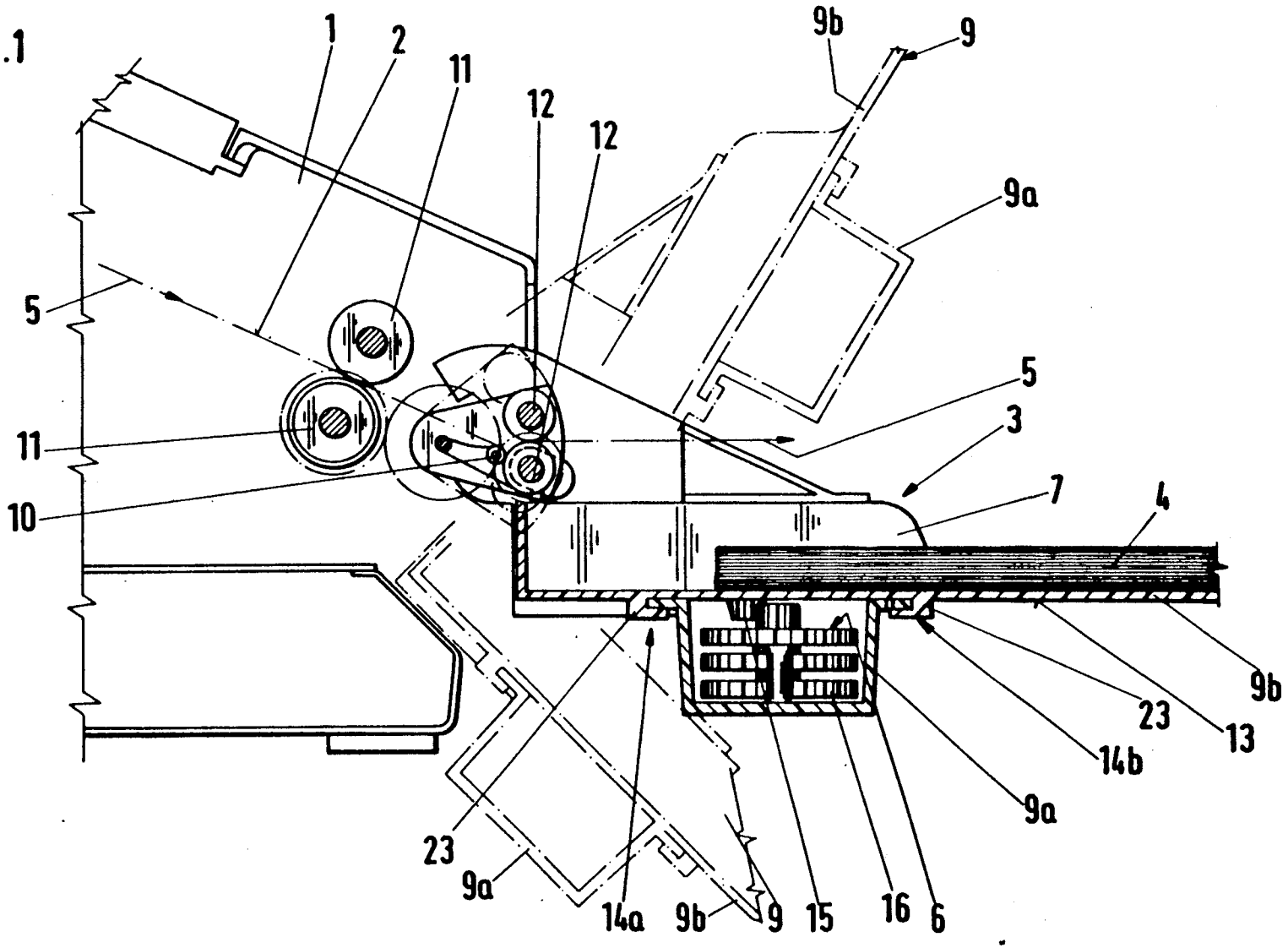
FIG. 1 is a sectional side view, partially broken away, of a printing station and an associated delivery device constructed in accordance with the present invention.

The printing station 1 may, for example, comprise a dot matrix printer, or a thermal-transfer printer, or a laser page printer, or other printer from which an individual printed sheet 2 is ejected printed-side-down. After printing of the individual sheet 2 in the station 1, the sheet is transported by or through a delivery device 3 and deposited in a stack 4. Sorting is effected in the course of delivery of the individual sheets 2, the sheets being deposited in laterally-staggered relation transverse to the sheet delivery direction 5 through operation of a transverse-displacement drive 6. The drive 6 is operable to displace a collection tray 7 along a transverse-displacement path 8 so that, as a function of the length 8*a* of the transverse-displacement path 8, groups 4*a* of individual sheets 2 protrude at their edges as for example seen in FIG. 2. Each of the individual stacks 4 and 4*a* form a sequence of progressively-numbered individual sheets 2 to define a set of sheets so that the user receives, in sorted condition, the desired x sets of documents from the printed sheet delivery device 3.

The delivery device 3 is constructed as a releasably-replaceable or mountable removable housing 9 that is separate from the printing station 1 and is pivotable with respect to the station 1 about a shaft 10 (FIG. 1). The individual printed sheets 2 are transported in the longitudinal delivery direction 5 between pairs of transport rolls 11, through pairs of delivery rolls 12 which are pivotable with the housing 9, and onto the integral collection tray 7. The housing 9 is formed by a lower housing part 9*a* and an upper housing 9*b* that interengage to define an interior space or cavity as will hereinafter be apparent. For this purpose, the bottom or underside 13 of the upper housing part 9*b* carries, on each of its lateral sides—i.e. on the sides defined transverse to the sheet delivery direction 5—slide guides 14*a*, 14*b*.

The transverse-displacement drive 6 is enclosed within the interior space or cavity defined by the interengaged lower and upper housing parts 9*a*, 9*b*. The drive 6 comprises a rack 15 secured to the upper housing part 9*b* and a transmission-like gearing or gear assembly 16 mounted to the lower housing part 9*a* and driven by an associated stepping motor 17. The electrical terminals of the stepping motor 17 may be releaseably connected to the printing station 1 by a cable to which a plug 20 is conventionally attached.

The lower housing part 9*a* carries upwardly-extending walls 19*a*, 19*b* at or proximate its lateral sides 18*a*, 18*b*, respectively. In the course of the operation of the delivery device 3 the upper housing part 9*b* is moveable in selectively reciprocatory back-and-forth relation between the walls 19*a* and 19*b* along the length 8*a* of the maximum transverse-displacement path 8.

Figure 2:
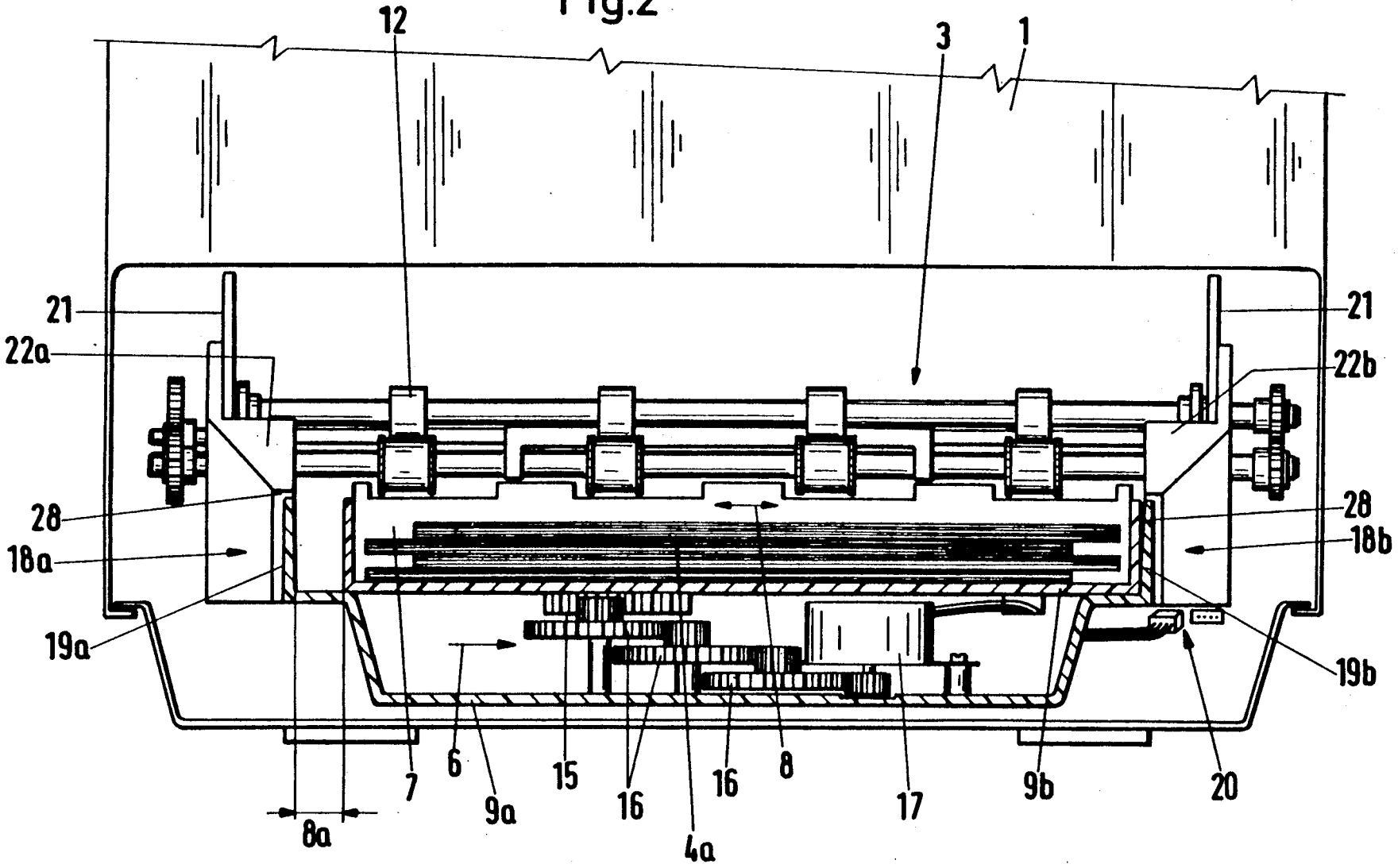
FIG. 2 is a sectional end view of the delivery device of FIG. 1.

The releasable removability or replaceability of the delivery device 3 is implemented by the inclusion of a pair of side parts or elements 22*a*, 22*b*. The elements 22*a*, 22*b* are, in accordance with a preferred form of the invention, releasably securable for pivotal movement to the printing station frame 21 (FIG. 2).

Figure 3:
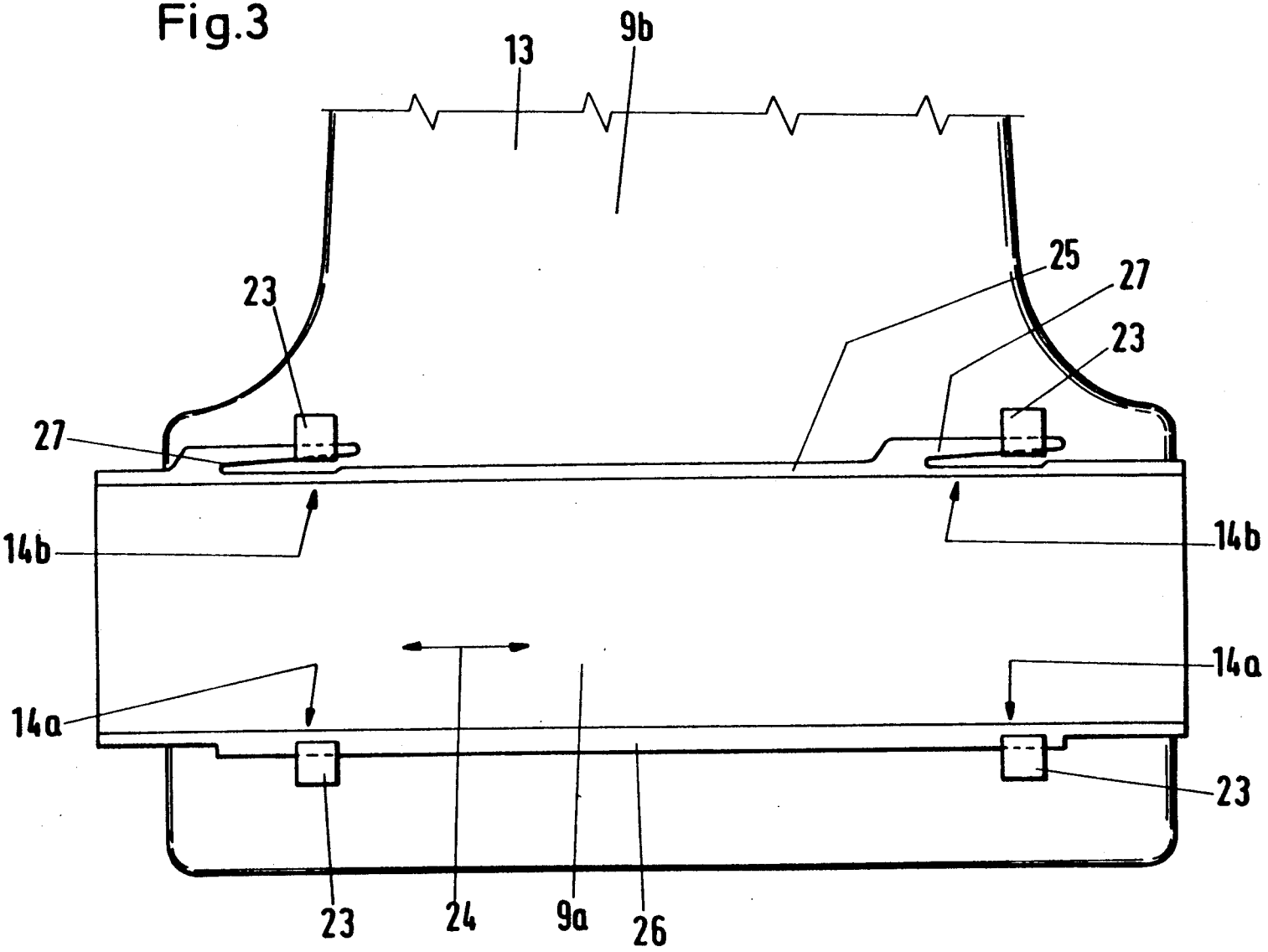
FIG. 3 is a sectional bottom plan view of the delivery device of FIGS. 1 and 2.

As seen in FIGS. 1 and 3, the slide guides 14*a*, 14*b* are defined as substantially L-shaped projections 23 from the bottom 13 of the upper housing part 9*b*.Is is preferred that the L-shaped projections 23 be arranged in sufficiently spaced-apart relation, in both the longitudinal and transverse directions of sheet movement, as to provide substantially canting-free guidance of the upper housing part 9*b* relative to the lower housing part 9*a*. In a currently preferred form of the delivery device 3 of the invention, the entire upper housing part 9*b*—including the L-shaped projections 23—are unitarily injection molded or otherwise fabricated of a suitable plastic material. The lower housing part 9*a* may also be advantageously molded or formed of a plastic material.

The lower housing part 9*a* carries integral guide ledges 25, 26 that are elongated and extend in the lengthwise or sheet feed direction 24 (FIG. 3), the guide ledge 25 being somewhat narrower than the guide ledge 26. The ledge 25 is also formed with resilient arms 27 which are located and configured for relatively slidable resilient engagement with the L-shaped projections 23 (FIG. 1). Thus, the resilient arms 27 engage the substantially L-shaped projections 23 and are effective to guide the selected transverse reciprocated or otherwise back and forth movement of the upper housing part 9*b* relative to the lower housing part 9*a* over the maximum transverse-displacement path length 8*a*. At the same time, the guide ledges 25, 26 contribute to the formation of a suitable seal between the lower and upper housing parts 9*a*, 9*b* so as to prevent uncontrolled penetration of dust or other particulate matter into the gears 16 of the transverse-displacement drive 6.

A particularly advantageous consequence of the disclosed structural arrangement and of the preferred fabrication of at least the upper housing part 9*b* of a plastic material enables the lower and upper housing parts 9*a*, 9*b* to be secured together without having to provide or rely on rivets or screws or any additional fastening structures or elements. Moreover, this construction permits repeated assembly and disassembly of the housing 9 should access to the interior of the housing be necessary such, for example, as for the purpose of conducting maintenance on the transverse-displacement drive 6.

Another particularly advantageous feature of the form of the invention herein disclosed is the fabrication of the housing 9 in two interengageable lower and upper housing parts 9*a*, 9*b*. This construction provides for relative transverse reciprocation or movability of the upper housing part 9*b*—on which the sheet collection tray 7 is defined and integrally carried—relative to the lower housing part 9*a* with slide guidance on and along the protected bottom 13 of the upper housing part 9*b*. At the same time, the housing 9 is easily, selectively and repeatably engageable in pivotally-supported relation on the printing station frame 21. Through the additional provision of an over-gripping contour 28 (FIG. 2), the delivery device 3 can be quickly and reliably removed and reinstalled on the printing station 1, it being necessary to merely disconnect and reconnect the electrical cable connector 20 as the unit is respectively removed and reinstalled.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A printed sheet delivery device (3) for use with a printing station (1), comprising:

an upper housing part (9*b*) including a collection tray (7) for receiving in stacked orientation printed sheets delivered in a longitudinal feed direction (5) from the printing station (1), said upper housing part (9*b*) including a bottom (13);

a lower housing part (9*a*);

means on said upper and lower housing parts (9*b*, 9*a*) for releasably securing said housing parts together with said upper housing part (9*b*) above said lower housing part (9*a*) and for relatively slidable movement therebetween and so as to define a delivery device housing (9) and an interior cavity within said housing (9), said means comprising slide guides (14*a*, 14*b*) disposed between the upper and lower housing parts (9*b*, 9*a*) and carried on the bottom (13) of said upper housing part (9*b*); and a transverse-displacement drive (6) substantially enclosed within said housing interior cavity and operable for selectively moving and reciprocating said upper housing part (9*b*) relative to said lower housing part (9*a*) along a direction transverse to said longitudinal feed direction of the printed sheets for receiving transversely-staggered stacks (4*a*) of printed sheets (2) on said collection tray (7);

said slide guides (14*a*, 14*b*) being disposed exteriorly of said housing interior cavity within which said transverse-displacement drive (6) is enclosed; and said housing (9) being separate from and releasably mountable to the printing station (1).

2. A printed sheet delivery device (3) in accordance with claim 1, wherein said transverse-displacement device (6) comprises a rack (15) on the housing upper part (9*b*), a stepping motor (17) on the housing lower part (9*a*), and a transmission gearing (16) connected to said stepping motor (17) and coupled to said rack (15) so that, on operation of said stepping motor (17), said upper housing part (9*b*) is driven through a transverse movement relative to said lower housing part (9*a*).

3. A printed sheet delivery device (3) in accordance with claim 1, wherein said lower housing part (9*a*) includes upwardly-extending side-mounted walls (19*a*, 19*b*) between which said upper housing part (9*b*) is transversely moveable.

4. A printed sheet delivery device (3) in accordance with claim 1, wherein the printing station (1) includes a frame (21), and said lower housing part (9*a*) includes a pair of side parts (22*a*, 22*b*) pivotally mountable in releasable relation to the printing station frame (21).

5. A printed sheet delivery device (3) in accordance with claim 3, wherein the printing station (1) includes a frame (21), and said lower housing part (9*a*) includes a pair of side parts (22*a*, 22*b*) pivotally mountable in releasable relation to the printing station frame (21).

6. A printed sheet delivery device (3) for use with a printing station (1), comprising:

an upper housing part (9*b*) including a collection tray (7) for receiving in stacked orientation printed sheets delivered in a longitudinal feed direction (5) from the printing station (1), said upper housing part (9*b*) including a bottom (13);

a lower housing part (9*a*);

means on said upper and lower housing parts (9*b*, 9*a*) for releasably securing said housing parts together with said upper housing part (9*b*) above said lower housing part (9*a*) and for relatively slidable movement therebetween and so as to define a delivery device housing (9) and an interior cavity within said housing (9), said means comprising slide guides (14*a*, 14*b*) disposed between the upper and lower housing parts (9*b*, 9*a*) and carried on the bottom (13) of said upper housing part (9*b*); and a transverse-displacement drive (6) substantially enclosed within said housing interior cavity and operable for selectively moving and reciprocating said upper housing part (9*b*) relative to said lower housing part (9*a*) along a direction transverse to said longitudinal feed direction of the printed sheets for receiving transversely-staggered stacks (4*a*) of printed sheets (2) on said collection tray (7);

said housing (9) being separate from and releasably mountable to the printing station (1); and wherein said slide guides (14*a*, 14*b*) comprise pairs of substantially L-shaped projections (23) on the bottom (13) of the upper housing part (9*b*), and said means further comprises a guide ledge (25) on said lower housing part (9*a*) and extending in the longitudinal feed direction (5), said guide ledge (25) including resilient arms (27) for relatively slidable engagement with said L-shaped projections to secure together said upper and lower housing parts (9*b*, 9*a*) and to guide said upper housing member (9*b*) through transverse movement relative to said lower housing member (9*a*).

7. A printed sheet delivery device (3) for use with a printing station (1), comprising:

an upper housing part (9*b*) including a collection tray (7) for receiving in stacked orientation printed sheets delivered in a longitudinal feed direction (5) from the printing station (1), said upper housing part (9*b*) including a bottom (13);

a lower housing part (9*a*);

means on said upper and lower housing parts (9*b*, 9*a*) for releasably securing said housing parts together with said upper housing part (9*b*) above said lower housing part (9*a*) and for relatively slidable movement therebetween and so as to define a delivery device housing (9) and an interior cavity within said housing (9), said means comprising slide guides (14*a*, 14*b*) disposed between the upper and lower housing parts (9*b*, 9*a*) and carried on the bottom (13) of said upper housing part (9*b*); and a transverse-displacment drive (6) substantially enclosed within said housing interior cavity and operable for selectively moving and reciprocating said upper housing part (9*b*) relative to said lower housing part (9*a*) along a direction transverse to said longitudinal feed direction of the printed sheets for receiving transversely-staggered stacks (4*a*) of printed sheets (2) on said collection tray (7);

said housing (9) being separate from and releasably mountable to the printing station (1); and wherein said slide guides (14*a*, 14*b*) comprise pairs of substantially L-shaped projections (23) on the bottom (13) of the upper housing part (9*b*), and said means further comprises first and second guides ledges (25, 26) on said lower housing part (9*a*) and extending in the longitudinal feed direction (5), said first guide ledge (25) being narrower than said second guide ledge (26) and including resilient arms (27) for relatively slidable engagement with said L-shaped projections to secure together said upper and lower housing parts (9*b*, 9*a*) and to guide said upper housing member (9*b*) through transverse movement relative to said lower housing member (9*a*).

* * * * *